US005368294A

United States Patent [19]

Mathey

[11] Patent Number: 5,368,294

[45] Date of Patent: Nov. 29, 1994

[54] FOOTBALL TEE

[76] Inventor: Maurice Mathey, 1917 Bark River Rd., Hartland, Wis. 53029

[21] Appl. No.: 93,404

[22] Filed: Jul. 19, 1993

[51] Int. Cl.[5] ..... A63B 67/00

[52] U.S. Cl. ..... 273/55 B

[58] Field of Search ..... 273/55 B, 29 R, 26 A, 273/29 A, 26 R

[56] References Cited

U.S. PATENT DOCUMENTS

| | | | |
|---|---|---|---|
| 3,105,686 | 10/1963 | Elsea | 273/55 B |
| 3,462,145 | 8/1969 | Shirley et al. | 273/55 B |
| 3,762,706 | 10/1973 | Cavett | 273/55 B |
| 3,897,948 | 8/1975 | Gerela | 273/55 B |
| 4,049,267 | 9/1977 | Forrest | 273/55 B |
| 4,546,974 | 10/1985 | Brown | 273/55 B |
| 4,632,395 | 12/1986 | Ferrebee | 273/55 B |
| 4,634,122 | 1/1987 | Kline | 273/55 B |
| 4,655,453 | 4/1987 | Spiegel | 273/55 B |
| 4,807,880 | 2/1989 | Deal | 273/55 B |
| 4,854,587 | 8/1989 | Groves | 273/26 R |
| 4,946,165 | 8/1990 | Rambacher | 273/55 B |

*Primary Examiner*—Theatrice Brown

*Attorney, Agent, or Firm*—Andrus, Sceales, Starke & Sawall

[57] ABSTRACT

A tee adapted to maintain the ends of a football in a place-kicking position includes a mounting device adapted to rest on a playing surface for locating one end of the football and a coiled retention arrangement operatively connected with the mounting device for holding the other end of the football in a teed-up position. The coiled retention arrangement is moveable between an uncoiled position for springably retaining the other end of the football in a teed-up position and a recoiled position for springably returning the coiled retention arrangement towards the mounting device after the football has been kicked.

5 Claims, 2 Drawing Sheets

FOOTBALL TEE

FIELD OF THE INVENTION

This invention generally relates to athletic appliances, and more particularly, pertains to a tee for football place-kicking.

BACKGROUND OF THE INVENTION

Football place-kicking tees are typically used to support the football in a kick-off situation. During windy conditions, it is often necessary for one of the players to hold the ball on the tee with a finger in order to prevent the ball from blowing off the tee. This delays the ball-holding player in advancing down the field to defend the kick-off. Further, the value of accurate place-kicking for scoring field goals and extra points has been recognized by modern football squads as a key component of offense in addition to their running and passing games. In order to develop and maintain place-kicking proficiency, kicking specialists realize that long hours of practice kicking are involved, generally requiring the participation of at least a holder to simulate actual game playing conditions. However, a holder cannot always be made available and the kicker must then resort to a holding device or a tee to maintain the football in a kicking position.

One device addressing the above problems is disclosed in U.S. Pat. No. 4,632,395 issued Dec. 30, 1986 to Ferrebee. In this arrangement, a football holding training device comprises a base and a series of pivotable arm elements mounted to the base, the outermost arm element of which terminates in a point for engaging the end of a football. Another holder is set forth in U.S. Pat. No. 4,634,122 issued Jan. 6, 1987 to Kline. The Kline device, which simulates the arm and holding finger of a human holder, includes a pivotal arm having a finger in the form of a flexible tube and tension adjustable means in the form of a weighted body mounted for movement along the arm. In U.S. Pat. No. 4,946,165 issued Aug. 7, 1990 to Rambacher, a football holder is disclosed in which a holding arm is pivotably attached to a vertical support member, tension being created on the holding arm by a stud and helical spring mechanism. While each of the aforementioned holding devices permit place-kicking without a human holder, certain disadvantages become readily apparent. For example, each device has rigid main components which may be contacted by a holder's foot and result in injury to it. In addition, each of these prior art holders has a relatively complicated tension adjusting mechanism which often creates a substantial drag on the football when it is kicked. Moreover, each device has multi-adjustable, pivotable connections which make manufacture and use of the device more complex and expensive than desired.

Accordingly, it is desirable to provide an improved football kicking tee which offers a greater degree of simplicity in construction and operation, and which will allow kickers to simulate their kicking game without human holders regardless of the type of playing surface or style of kicking employed. It is further desirable to provide a football tee which can easily tension the football in a substantially vertical or angular position so that it will not fall from or be blown from a kicking position.

SUMMARY OF THE INVENTION

The present invention advantageously provides an improved football tee having a unique holding arrangement for maintaining a football in teed-up position which incorporates an easy on, easy off construction. The improved tee is relatively simple, affordable, and can be used by right or left foot, or traditional or soccer kickers on any type of playing surface.

These and other advantages are realized in one aspect of the invention by an improved tee adapted to maintain the end of a football in a place-kicking position and comprising a mounting device adapted to rest on a playing surface for locating one end of the football thereon and a coiled retention arrangement operatively connected with the mounting device for holding the other end of the football in the teed-up position.

In a highly preferred embodiment, the invention contemplates a tee comprising a base adapted to rest on a playing surface, and a flexible, one-piece sleeve having a distal end pivotally connected to the base about a horizontal axis disposed substantially perpendicular to the longitudinal axis of the football, and a proximal end disposable adjacent an upper end of the football. A flexible tongue is telescopically mounted in the sleeve and engageable with an upper end of the football for creating a variable tension on and maintaining a teed-up attitude for the football.

The invention also envisions a tee adapted to maintain a football in place-kicking position and comprising a base adapted to rest on a playing surface, the base having a platform and a plurality of legs for supporting the platform above the playing surface and having a depression formed therein for locating the lower end of the football. A flexible, continuous, C-shaped sleeve has a distal end pivotally and frictionally mounted on the side of the base and a proximal end disposable adjacent an upper end of the football. A flexible, elongated tongue is telescopically mounted within the sleeve, the tongue being engageable with the upper end of the football in an operating position and being recessable beneath the base in a storage position.

BRIEF DESCRIPTION OF THE DRAWINGS

The invention will become better understood by reference to the following detailed description of the preferred exemplary embodiment when read in conjunction with the appended drawing, wherein like numerals denote like elements and.

DETAILED DESCRIPTION OF THE PREFERRED EMBODIMENT

Figure 1:
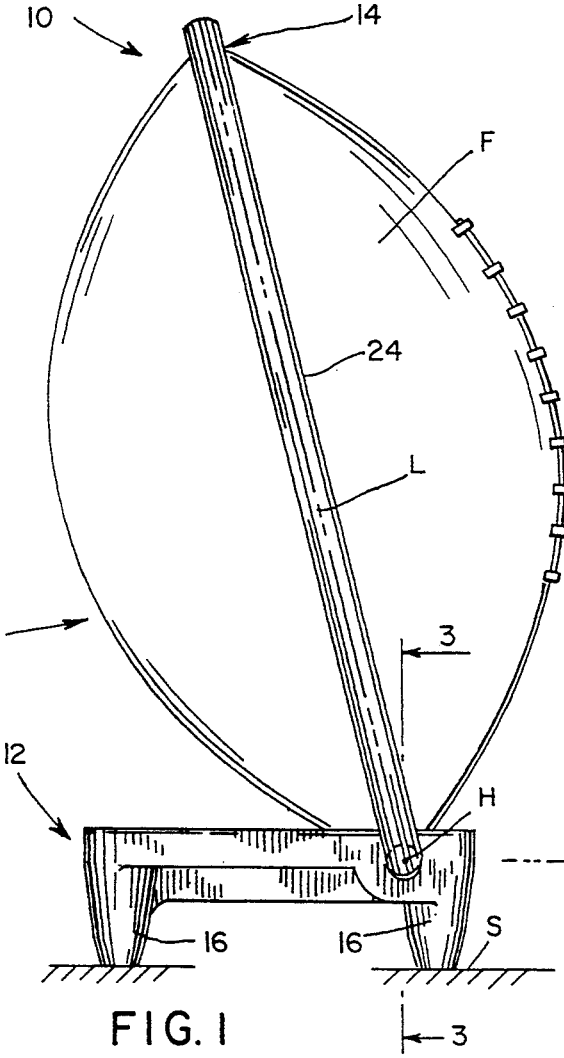
FIG. 1 is a side elevational view of the preferred embodiment of a football place-kicking tee embodying improved features of the present invention.

Referring now to the drawings, FIGS. 1–6, there is shown a football place-kicking tee generally designated by the numeral 10 and constituting the preferred embodiment of the present invention. In its basic components, tee 10 includes a mounting device in the form of a ball-supporting base or platform 12 and a coiled retention arrangement 14.

Mounting device 12 is a base in the form of a generally triangular platform adapted to rest on a playing surface and generally defining a location for placing a football F in a teed-up position. Preferably, base 12 is formed with three legs 16, each of which depend from a corner of the platform such that the base 12 is raised above a playing surface S. Each of the legs 16 are weighted to add stability to base 12 such as by molding a metal weight (not shown) internally within each leg 16. An oval, dished depression 18 is formed on the forward end of the platform in its upper surface, to receive the lower end of the football F in a teed-up position.

Figure 5:
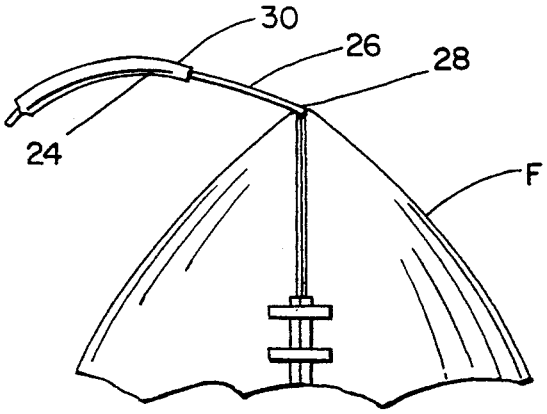

One side of base 12 is formed with a recess 20 which pivotally and frictionally receives a distal end 22 of coiled retention arrangement 14. This arrangement comprises a flexible, curved arm in the form of a generally C-shaped, resilient sleeve 24, and further includes a complementary shaped tongue 26 slidably and telescopically mounted within the sleeve and having a pointed free end 28 protruding from the sleeve, the free end providing variable tension on the other end of football F. Sleeve 24 has a proximal end 30 disposable adjacent the upper end of football F from which end tongue 26 protrudes. Tongue 26 is retractable with respect to sleeve 24 to increase the amount of tension when it is engageable with the upper end of football (FIG. 4) and is extendable with respect to the sleeve 24 to decrease the amount of tension when it is engageable with the upper end of football (FIG. 5).

Mounting base 12 can be manufactured of urethane as one integral unit, including the legs 16 and depression 18 by well known manufacturing methods, such as by plastic molded injection. Likewise, sleeve 24 and cooperating tongue 26 may each be integrally as well as continuously formed from a polyurethane material. As a salient feature of the invention, sleeve 24 and tongue 26 are constructed in a coiled configuration of memory plastic which is moveable between an uncoiled, extended position for springably retaining the other end of football F in the teed-up position, and a recoiled position for springably returning sleeve 24 and tongue 26 towards mounting base 12 after football F has been kicked.

Figure 2:
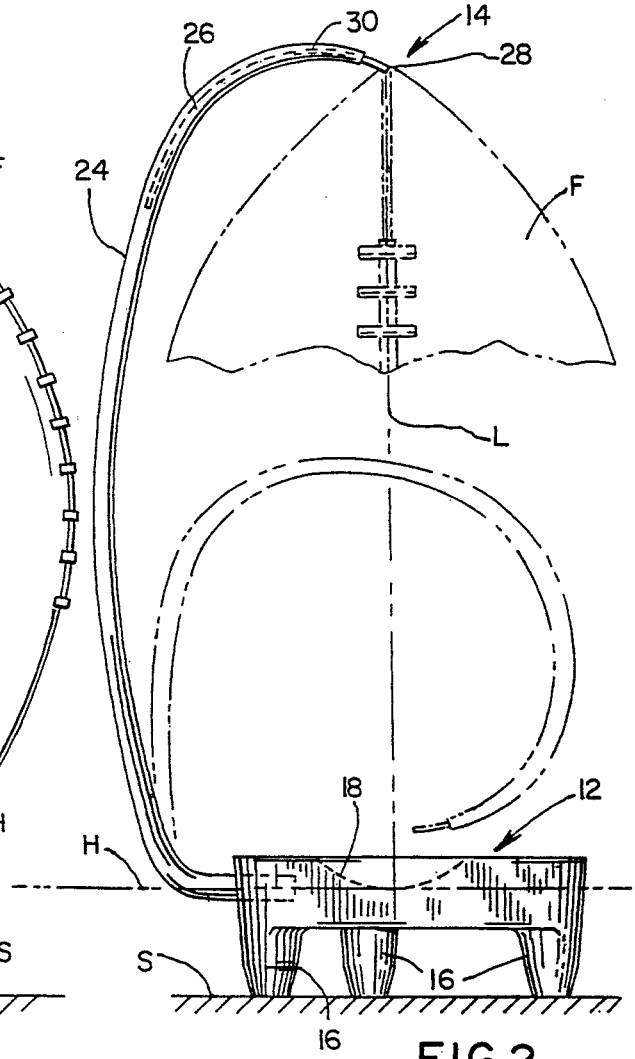
FIG. 2 is a front elevational view of the tee shown in FIG. 1, showing a coiled retention arrangement holding the football in a teed-up position and showing the retention device in phantom lines after the football has been kicked.
Figure 3:
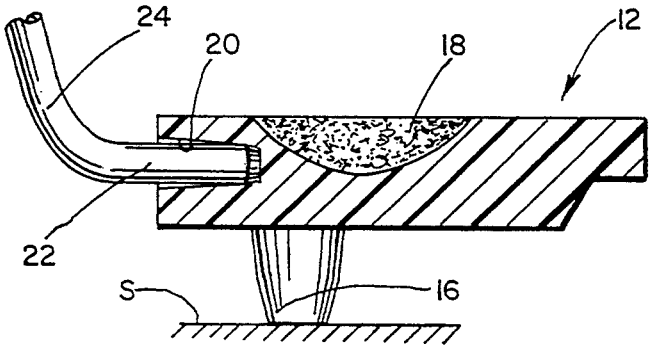
FIG. 3 is a cross-sectional view taken on line 3—3 of FIG. 1.
Figure 6:
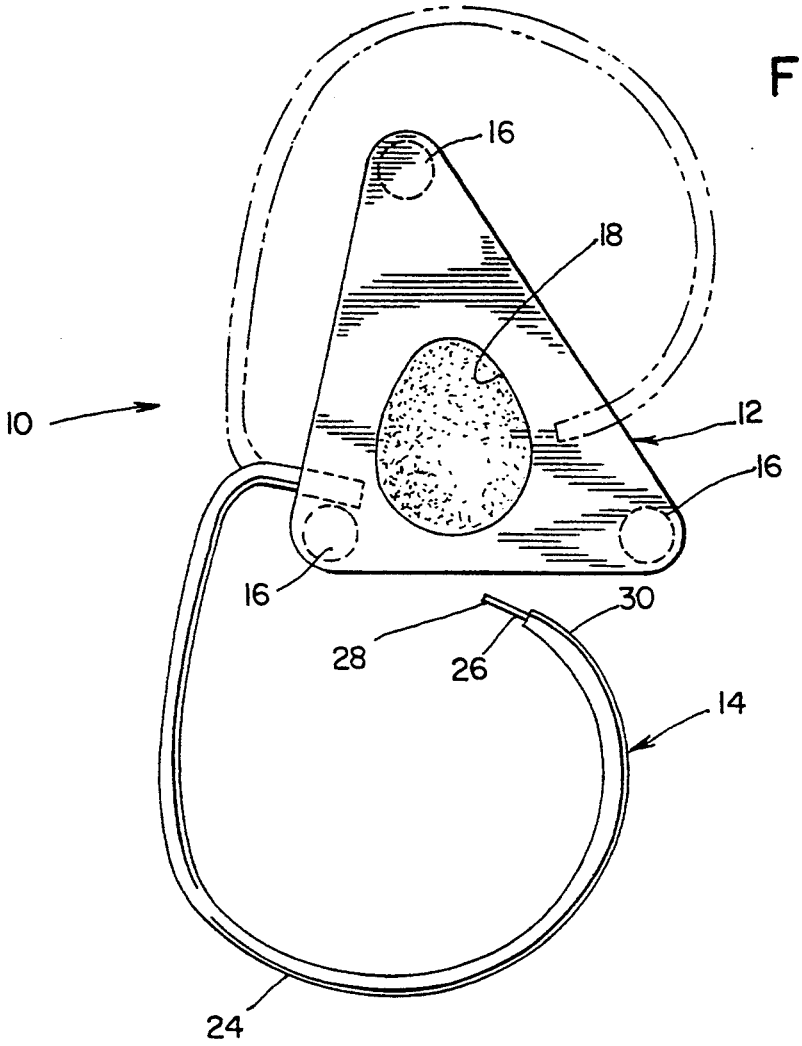
FIG. 6 is a top view of the tee shown in FIG. 1 with the football removed and the coil retention device being pivoted to one side or another of the tee.
Figure 4:
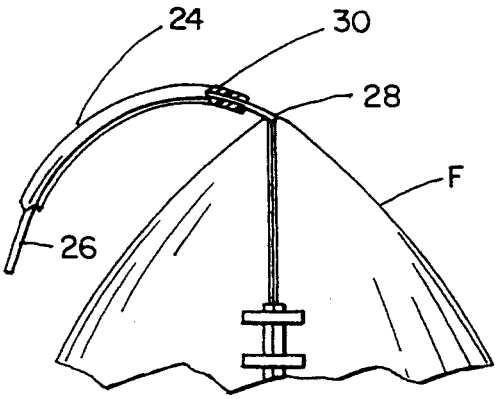
FIGS. 4 and 5 are fragmentary, front elevational views depicting different tension adjusting arrangements for maintaining the football in a teed-up position.

As can be appreciated from FIGS. 1 and 2, sleeve 24 and tongue 26 can be pivoted about a horizontal axis H which is perpendicular to the longitudinal axis L of football F to one side or another of base 12 such that in one position, (FIG. 6) ends 28, 30 are recessable beneath base 12 in a storage position. Otherwise stated, sleeve 24 is pivotable to a horizontal plane lying between the planes of platform 12 and playing surface S.

In operation, the lower end of football F is positioned in the depression 18 and retention arrangement 14 is simply pivoted and extended upwardly into an uncoiled position such that end 28 of tongue 26 springably engages football in a desired teed-up position which is vertical or slightly angular with respect to mounting base 12 as shown in FIG. 1. The kicker can easily adjust the angle of football F relative to surface S by pivoting sleeve 24 relative to base 12 about its horizontal pivot axis H. In all angular positions, sleeve 24 and tongue 26 exert a biasing force on football F along its longitudinal axis L, and depression 18 functions to maintain the lower end of football F in engagement with base 12. The kicker then kicks the football in the direction indicated by the arrow (FIG. 1) after which retention arrangement 14 simply springs back to a recoiled position as shown in FIG. 2, wherein the ends 28, 30 of tongue 26 and sleeve 24 respectively, move back towards base 12.

It should be recognized that the present invention may be utilized by different type of kickers and with different size footballs with no change in operation and no loss in efficiency. Because of its preferred plastic construction, a kicking tee is provided which is extremely durable, yet soft and pliable and economical to manufacture. Unlike prior art holding devices, the present invention has a minimum number of components which enable simplicity in construction and operation, especially with respect to the tensioning mechanism and ease of locating a football in any desired kick-off or teed-up position.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention as set forth in the following claims.

I claim:

1. A tee adapted to maintain a football in a place kicking position, said tee comprising:

a base adapted to rest on a playing surface;

a flexible, one piece sleeve having a distal end pivotally connected to said base about a horizontal axis disposed substantially perpendicular to the longitudinal axis of the football and a proximal end disposable adjacent an upper end of the football; and a flexible tongue telescopically mounted in said sleeve and engageable with an upper end of the football for creating a variable tension on and maintaining a teed-up attitude for the football.

2. The tee as recited in claim 1, wherein said sleeve is pivotable to a plane lying between said platform and the playing surface.

3. A tee adapted to maintain a football in a place kicking position, said tee comprising:

a base adapted to rest on a playing surface, said base having a platform and a plurality of legs for supporting said formed therein for locating a lower end of the football;

a flexible, continuous C-shaped sleeve having a distal end pivotally and frictionally mounted on a side of said base and a proximal end disposable adjacent an upper end of the football; and a flexible, elongated tongue telescopically mounted within said sleeve, said tongue being engageable with the upper end of the football in an operating position and being disengageable with the upper end of the football and movable with said sleeve adjacent said base in a storage position.

4. The tee as recited in claim 3, said tongue being extendable with respect to said sleeve to decrease the amount of tension when engageable with the upper end of the football.

5. The tee as recited in claim 3, said tongue being retractable with respect to said sleeve to increase the amount of tension when engageable with the upper end of the football.

* * * * *

UNITED STATES PATENT AND TRADEMARK OFFICE

CERTIFICATE OF CORRECTION

PATENT NO. : 5,368,294

DATED : November 29, 1994

INVENTOR(S) : Maurice Mathey

It is certified that error appears in the above-indentified patent and that said Letters Patent is hereby corrected as shown below:

CLAIM 3, Col. 4, Line 48, after "said", insert ---platform above the playing surface, said base having a depression---.

Signed and Sealed this

Seventh Day of February, 1995

*Attest:*

Bruce Lehman

BRUCE LEHMAN

*Attesting Officer*

*Commissioner of Patents and Trademarks*